US010182296B2

(12) United States Patent
Oliaei et al.

(10) Patent No.: US 10,182,296 B2
(45) Date of Patent: Jan. 15, 2019

(54) SECURE AUDIO SENSOR

(71) Applicant: INVENSENSE, INC., San Jose, CA (US)

(72) Inventors: Omid Oliaei, Sunnyvale, CA (US); Fariborz Assaderaghi, Emerald Hills, CA (US)

(73) Assignee: INVENSENSE, INC., San Jose, CA (US)

( * ) Notice: Subject to any disclaimer, the term of this patent is extended or adjusted under 35 U.S.C. 154(b) by 62 days.

(21) Appl. No.: 14/537,991

(22) Filed: Nov. 11, 2014

(65) Prior Publication Data

US 2016/0134973 A1 May 12, 2016

(51) Int. Cl.

| | |
|---|---|
| ***H04R 17/02*** | (2006.01) |
| ***H04R 19/04*** | (2006.01) |
| *H04R 1/10* | (2006.01) |
| *H04R 19/00* | (2006.01) |

(52) U.S. Cl.

CPC ..... *H04R 17/02* (2013.01); *H04R 19/04* (2013.01); *H04R 1/1041* (2013.01); *H04R 19/005* (2013.01); *H04R 2201/003* (2013.01)

(58) Field of Classification Search

CPC ..... H04R 3/00; H04R 17/02; H04R 19/04; H04R 19/005; H04R 2201/003; H04R 1/1041; H03G 3/34; H03G 3/348

USPC ..... 381/91–92, 122, 120, 94.5, 123

See application file for complete search history.

(56) References Cited

U.S. PATENT DOCUMENTS

| | | | | |
|---|---|---|---|---|
| 6,028,946 | A * | 2/2000 | Jahne | H04R 3/00 381/111 |
| 8,311,241 | B1 * | 11/2012 | Jordahl | H04R 3/00 330/271 |
| 8,625,809 | B2 * | 1/2014 | Josefsson | H04R 3/06 381/354 |
| 2005/0184704 | A1 * | 8/2005 | Patino | H02J 7/0004 320/150 |
| 2006/0018494 | A1 * | 1/2006 | Van Halteren | H04R 25/43 381/171 |
| 2006/0140435 | A1 * | 6/2006 | Sheehy | H04R 1/1041 381/390 |
| 2008/0157129 | A1 * | 7/2008 | Hsu | H04R 1/04 257/254 |

(Continued)

OTHER PUBLICATIONS

International Search Report and Written Opinion dated Apr. 4, 2016 for PCT Application Serial No. PCT/US2015/059741, 18 pages.

(Continued)

*Primary Examiner* — Disler Paul

(74) *Attorney, Agent, or Firm* — Amin, Turocy & Watson, LLP

(57) ABSTRACT

Providing security features in an audio sensor is presented herein. A micro-electro-mechanical system (MEMS) microphone can include an acoustic membrane that converts an acoustic signal into an electrical signal; an electronic amplifier that increases an amplitude of the electrical signal to generate an amplified signal; and switch(es) configured to prevent propagation of a direct current (DC) voltage source to the MEMS microphone; prevent propagation of the DC voltage source to the electronic amplifier; prevent propagation of the electrical signal to the electronic amplifier; and/or prevent propagation of the amplified signal to an external device.

19 Claims, 17 Drawing Sheets

(56) References Cited

U.S. PATENT DOCUMENTS

| | | | | |
|---|---|---|---|---|
| 2010/0166228 | A1* | 7/2010 | Steele | A61B 8/4444 381/113 |
| 2013/0195291 | A1* | 8/2013 | Josefsson | H02M 3/07 381/174 |
| 2013/0329920 | A1 | 12/2013 | Grosh et al. | |
| 2014/0086433 | A1* | 3/2014 | Josefsson | H04R 3/06 381/98 |
| 2014/0140538 | A1* | 5/2014 | Kropfitsch | H03G 3/002 381/106 |
| 2014/0241555 | A1* | 8/2014 | Terlizzi | H04B 5/0006 381/315 |
| 2015/0131820 | A1* | 5/2015 | Veneri | H04R 23/00 381/174 |
| 2015/0181335 | A1* | 6/2015 | Florian | H04R 3/02 381/94.1 |
| 2015/0256914 | A1* | 9/2015 | Wiesbauer | H04R 3/00 381/174 |
| 2016/0066113 | A1* | 3/2016 | Elkhatib | H04R 29/004 381/56 |
| 2017/0034618 | A1* | 2/2017 | Negi | H04M 1/6058 |

OTHER PUBLICATIONS

European Office Action for European Application No. 15797552.5 dated Jun. 22, 2017, 2 pages.

* cited by examiner

SECURE AUDIO SENSOR

TECHNICAL FIELD

The subject disclosure generally relates to embodiments for a secure audio sensor.

BACKGROUND

Security and privacy of mobile devices has become a growing concern for consumers. Although protecting data generated by a user has been important, of particular interest is protecting audio data, i.e., of a conversation of the user. Conventionally, microphones can be activated without knowledge of the user, and sensitive data can be compromised as encryption algorithms are executed physically, electrically, or algorithmically far from an audio source of such data. In this regard, conventional audio technologies have had some drawbacks, some of which may be noted with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
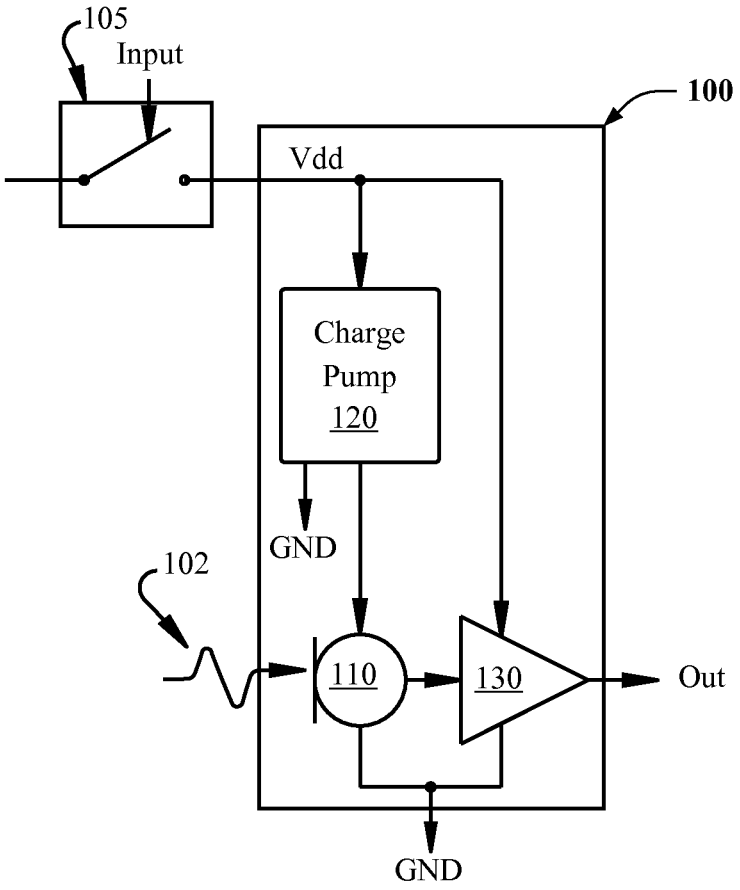
FIG. 1 illustrates a block diagram of a micro-electro-mechanical system (MEMS) microphone with a switch for controlling propagation of a direct current (DC) voltage source to the MEMS microphone, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Conventional audio technologies have had some drawbacks with respect to securing audio data, including activating a microphone without a user's knowledge, and encrypting such data remote from an audio source. Various embodiments disclosed herein can improve security of audio data by implementing security features, measures, etc. close to, near, within, etc. an audio source, e.g., a MEMS microphone.

For example, a MEMS microphone can include an acoustic membrane that converts an acoustic signal into an electrical signal; an electronic amplifier that increases an amplitude of the electrical signal to generate an amplified signal; and switch(es) configured to: prevent propagation of a direct current (DC) voltage source to the MEMS microphone; prevent propagation of the DC voltage source to the electronic amplifier; prevent propagation of the electrical signal to the electronic amplifier; and/or prevent propagation of the amplified signal to an external device.

In one embodiment, the MEMS microphone is a piezoelectric or piezoresistive device. In another embodiment, the MEMS microphone can include a charge pump that applies a bias voltage to the acoustic membrane and the switch(es). In this regard, the switch(es) can further be configured to prevent propagation of the DC voltage source to the charge pump and/or prevent propagation of the bias voltage to the acoustic membrane.

In an embodiment, the switch(es) can include a mechanical switch and/or an electrical switch. In one embodiment, the switch(es) can include a sensor, a touch sensor, a proximity sensor, and/or a fingerprint sensor. In another embodiment, the MEMS microphone can include an ADC that converts the amplified signal into a digital, e.g., binary, representation of the amplified signal. In yet another embodiment, the switch(es) can prevent propagation of the DC voltage source to the ADC. In an embodiment, the switch(es) can prevent propagation of the digital representation of the amplified signal to the external device. In one embodiment, the switch(es) can prevent propagation of a clock input to the ADC.

In other embodiment(s), the MEMS microphone can include a source power pin that electrically couples the DC voltage source to the MEMS microphone, a ground power pin that electrically couples the DC voltage source to the MEMS microphone, an output pin that electrically couples the amplified signal to the external device, and an enable pin that electrically couples an input signal to the switch(es). In this regard, the switch(es) can prevent, based on the input signal, the propagation of the DC voltage source to the MEMS microphone, the propagation of the DC voltage source to the charge pump, the propagation of the DC voltage source to the electronic amplifier, the propagation of the bias voltage to the acoustic membrane, the propagation of the electrical signal to the electronic amplifier, and/or the propagation of the amplified signal to the external device.

In another embodiment, the MEMS microphone can include a data pin that electrically couples the digital representation of the amplified signal to the external device, and a clock pin that electrically couples a clock input to the ADC. In this regard, the switch(es) can prevent, based on the input signal, the propagation of the digital representation of the amplified signal to the external device, and/or the propagation of the clock input to the ADC.

In one embodiment, a MEMS microphone can include an acoustic membrane that converts, e.g., based on a bias voltage, an acoustic vibration into an electrical signal an electronic amplifier that increases an amplitude of the electrical signal to generate an amplified electrical signal; and switch(es) configured to prevent propagation of the electrical signal to the electronic amplifier and/or prevent propagation of the amplified electrical signal to an external device. In an embodiment, the switch(es) can include a mechanical switch and/or an electrical switch. In another embodiment, the switch(es) can comprise a sensor, a touch sensor, a proximity sensor, and/or a fingerprint sensor.

In yet another embodiment, the MEMS microphone can include an ADC that converts the amplified electrical signal into a digital value. In one embodiment, the MEMS microphone can include a switch configured to prevent propagation of the amplified electrical signal to the ADC. In an embodiment, the MEMS microphone can include a switch configured to prevent propagation of the digital value to the external device.

In another embodiment, the MEMS microphone can include a source power pin that electrically couples a DC voltage source to the electronic amplifier, a ground power pin that electrically couples the DC voltage source to the electronic amplifier, an output pin that electrically couples the amplified electrical signal to the external device; and an enable pin that electrically couples an input signal to the switch(es). In this regard, the switch(es) can prevent, based on the input signal, the propagation of the electrical signal to the electronic amplifier, and/or the propagation of the amplified electrical signal to the external device.

In yet another embodiment, the MEMS microphone can include a data pin that electrically couples the digital value to the external device, and a clock pin that electrically couples a clock input to the ADC. In this regard, the switch(es) can prevent, based on the input signal, the propagation of the digital value to the external device, and/or the propagation of the clock input to the ADC.

In an embodiment, a MEMS microphone can include an acoustic membrane for converting an acoustic wave into an electrical signal; an electronic amplifier that increases an amplitude of the electrical signal to generate an amplified electrical signal; an ADC that converts the amplified electrical signal into a digital value; a memory to store executable instructions; and a processor, coupled to the memory, that facilitates execution of the executable instructions to perform operations, comprising: encrypting the digital value as encrypted data; and sending the encrypted data directed to an external device.

In one embodiment, the encrypting can include compressing the digital value as compressed data, and encrypting the compressed data as the encrypted data. In another embodiment, the encrypting can further include receiving an input, and encrypting, based on the input, the digital value as the encrypted data. In yet another embodiment, the encrypting can further include receiving, via the acoustic membrane, voice data representing a voice of a user of the MEMS microphone, and storing the voice data in the memory.

In an embodiment, the receiving of the input can include receiving, via the acoustic membrane, an ultrasonic signal. In this regard, the encrypting can include encrypting, based on the ultrasonic signal, the digital value as the encrypted data. In another embodiment, the receiving of the voice data can include storing a voice recognition algorithm in the memory, and receiving the voice data using the voice recognition algorithm. In yet another embodiment, the encrypting can include verifying that the voice data corresponds to the user of the MEMS microphone utilizing speaker authentication or verification, and in response to the verifying of the voice data, encrypting the digital value as the encrypted data.

In an embodiment, the sending of the encrypted data can include sending the encrypted data via a serial peripheral interface (SPI), an inter-integrated circuit ($I^2C$) interface, and/or SoundWire interface. In another embodiment, the operations can further include sending an output signal directed to an external device, e.g., a camera, a sensor, a light emitting diode (LED), etc.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Aspects of MEMS microphones, apparatus, devices, processes, and process blocks explained herein can constitute machine-executable instructions embodied within a machine, e.g., embodied in a memory device, computer readable medium (or media) associated with the machine. Such instructions, when executed by the machine, can cause the machine to perform the operations described. Additionally, aspects of the MEMS microphones, apparatus, devices, processes, and process blocks can be embodied within hardware, such as an application specific integrated circuit (ASIC) or the like. Moreover, the order in which some or all of the process blocks appear in each process should not be deemed limiting. Rather, it should be understood by a person of ordinary skill in the art having the benefit of the instant disclosure that some of the process blocks can be executed in a variety of orders not illustrated.

Furthermore, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art having the benefit of the instant disclosure.

Conventional audio technologies have had some drawbacks with respect to securing audio data. On the other hand, various embodiments disclosed herein can improve audio data security by implementing security features, e.g., switches, encryption, etc. within, near, etc. a MEMS microphone. In this regard, and now referring to FIG. 1, MEMS microphone 100 can include acoustic membrane 110 that converts, based on a bias voltage generated by charge pump 120, acoustic signal 102, e.g., a sound, an acoustic wave, an acoustic-based vibration, etc. into an electrical signal—charge pump 120 applying the bias voltage to acoustic membrane 110 as a function of a DC voltage source supplying power to charge pump 120. Further MEMS microphone 100 can include electronic amplifier 130 that increases an amplitude of the electrical signal to generate an amplified signal, acoustic-based electrical signal, etc., e.g., "Out" that can be output to an external device, e.g., processing device, etc. via a pin (not shown) of MEMS microphone 107, e.g., for processing of the amplified signal.

In an embodiment illustrated by FIG. 1, switch 105, e.g., a mechanical switch, an electrical switch, e.g., a complementary metal-oxide-semiconductor (CMOS) based switch, a sensor, a touch sensor, a capacitive sensor, a proximity sensor, a fingerprint sensor, etc. can be electrically coupled to MEMS microphone 100, e.g., via an external interface, pin, etc. (not shown) of MEMS microphone 100. In this regard, switch 105 can prevent, via an input, e.g., "Input", received from a user of a device (not shown), e.g., a portable wireless device, a cellular phone, etc. that includes MEMS microphone 100, propagation of the DC voltage source to MEMS microphone 100, e.g., disabling MEMS microphone 100 to prevent audio data from being generated. Although not shown, it should be appreciated that in other embodiments, switch 105 can be included within MEMS microphone 100, e.g., controlling propagation of the DC voltage source to various components, devices, etc. of MEMS microphone 100, e.g., controlling propagation of the DC voltage source to acoustic membrane 110, charge pump 120, and electronic amplifier 130.

Figure 2:
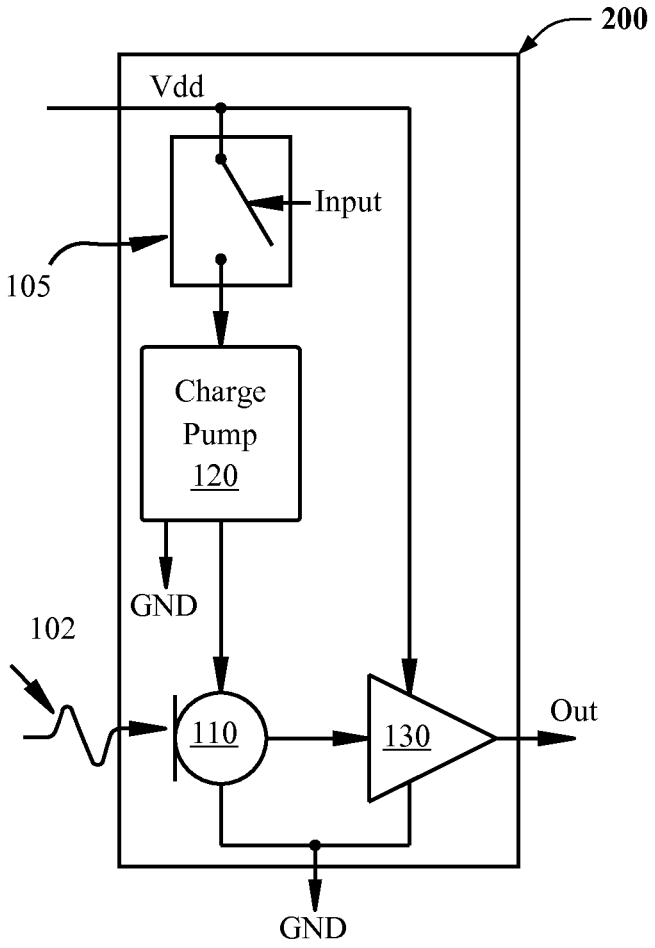
FIG. 2 illustrates a block diagram of a MEMS microphone with a switch for controlling propagation of a DC voltage source to a charge pump of the MEMS microphone, in accordance with various embodiments.

Referring now to FIG. 2, switch 105, e.g., a mechanical switch, an electrical switch, e.g., a CMOS based switch, a sensor, a touch sensor, a capacitive sensor, a proximity sensor, a fingerprint sensor, etc. included within MEMS microphone 200 can prevent, based on an input, e.g., "Input", received from a user of a device (not shown), e.g., a portable wireless device, a cellular phone, etc. including MEMS microphone 200, propagation of the DC voltage source to charge pump 120, e.g., disabling charge pump 120 to prevent generation of audio data from acoustic membrane 110.

Figure 3:
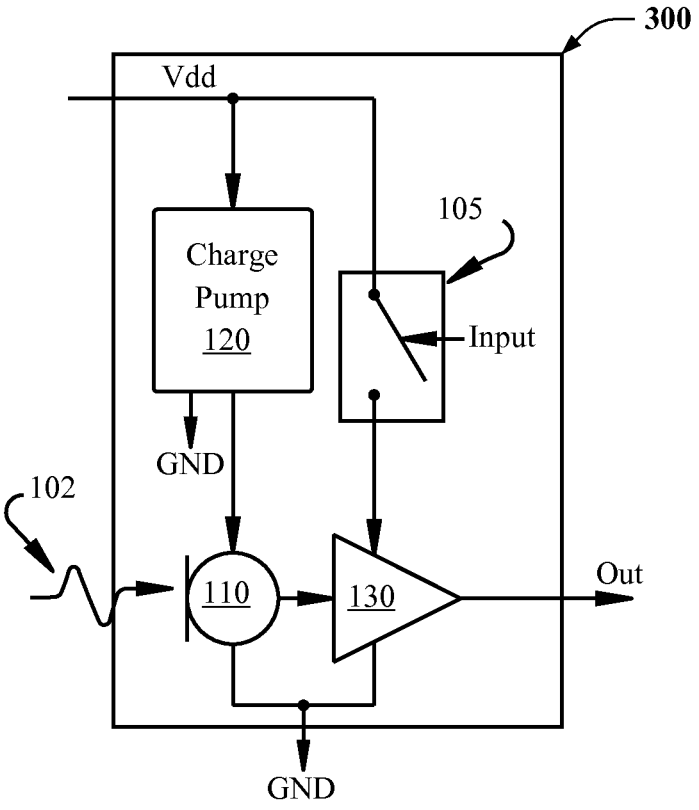
FIG. 3 illustrates a block diagram of a MEMS microphone with a switch for controlling propagation of a DC voltage source to an electronic amplifier of the MEMS microphone, in accordance with various embodiments.

In an embodiment illustrated by FIG. 3, switch 105, e.g., a mechanical switch, an electrical switch, e.g., a CMOS based switch, a sensor, a touch sensor, a capacitive sensor, a proximity sensor, a fingerprint sensor, etc. included within MEMS microphone 300 can prevent, based on an input, e.g., "Input", received from a user of a device (not shown), e.g., a portable wireless device, a cellular phone, etc. including MEMS microphone 300, propagation of the DC voltage source to electronic amplifier 130, e.g., disabling electronic amplifier 130 to prevent generation of audio data from MEMS microphone 300.

Figure 4:
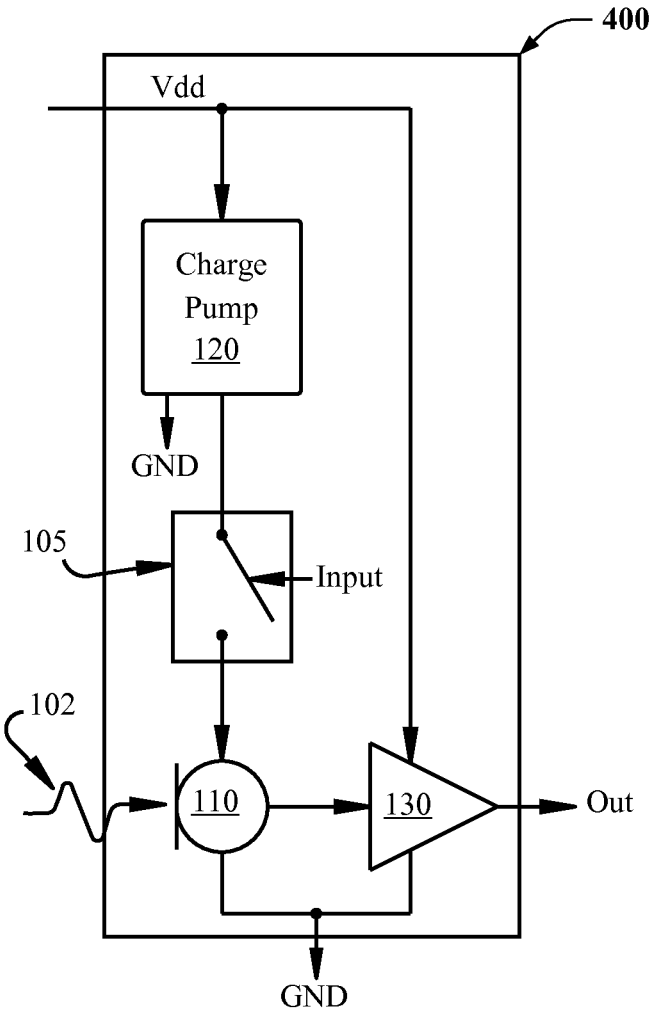
FIG. 4 illustrates a block diagram of a MEMS microphone with a switch for controlling propagation of a bias voltage to an acoustic membrane, in accordance with various embodiments.

FIG. 4 illustrates an embodiment in which MEMS microphone 400 includes switch 105, e.g., a mechanical switch, an electrical switch, e.g., a CMOS based switch, a sensor, a touch sensor, a capacitive sensor, a proximity sensor, a fingerprint sensor, etc. that can prevent, based on an input, e.g., "Input", received from a user of a device (not shown), e.g., a portable wireless device, a cellular phone, etc. including MEMS microphone 400, propagation of the bias voltage to acoustic membrane 110, e.g., preventing generation of an electrical signal from acoustic membrane 110.

Figure 5:
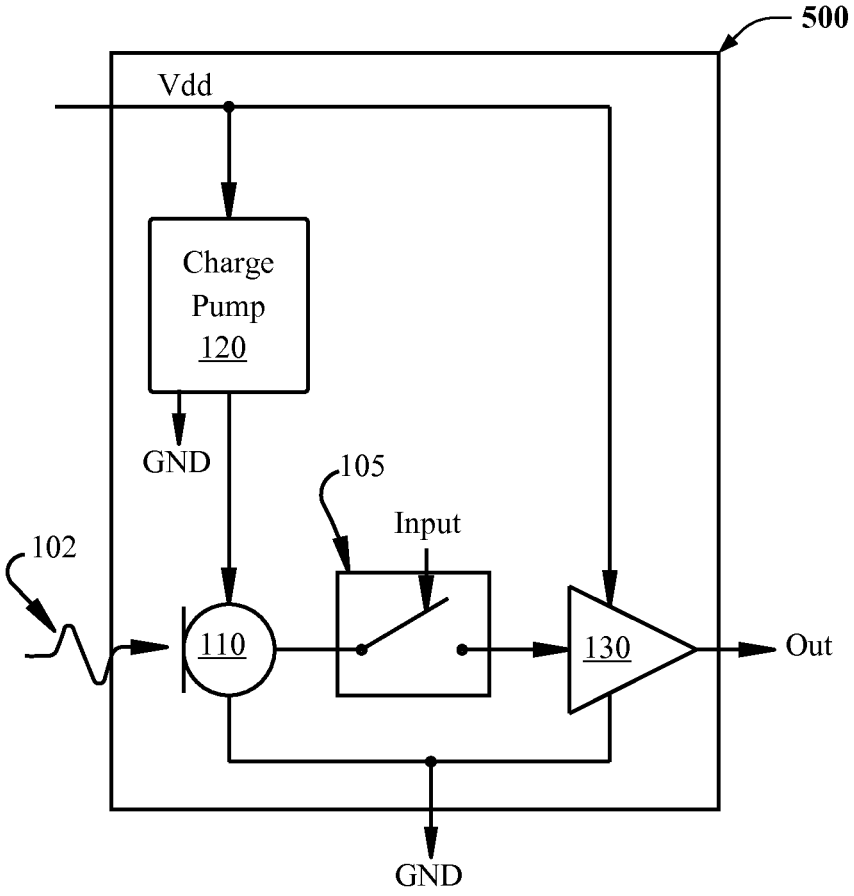
FIG. 5 illustrates a block diagram of a MEMS microphone with a switch for controlling propagation of an electrical signal between an acoustic membrane and an electronic amplifier, in accordance with various embodiments.

FIG. 5 illustrates an embodiment in which MEMS microphone 500 includes switch 105, e.g., a mechanical switch, an electrical switch, e.g., a CMOS based switch, a sensor, a touch sensor, a capacitive sensor, a proximity sensor, a fingerprint sensor, etc. that can prevent, based on an input, e.g., "Input", received from a user of a device (not shown), e.g., a portable wireless device, a cellular phone, etc. including MEMS microphone 500, propagation of the electrical signal from acoustic membrane 110 to electronic amplifier 130, e.g., preventing generation of audio data via electronic amplifier 130.

Figure 6:
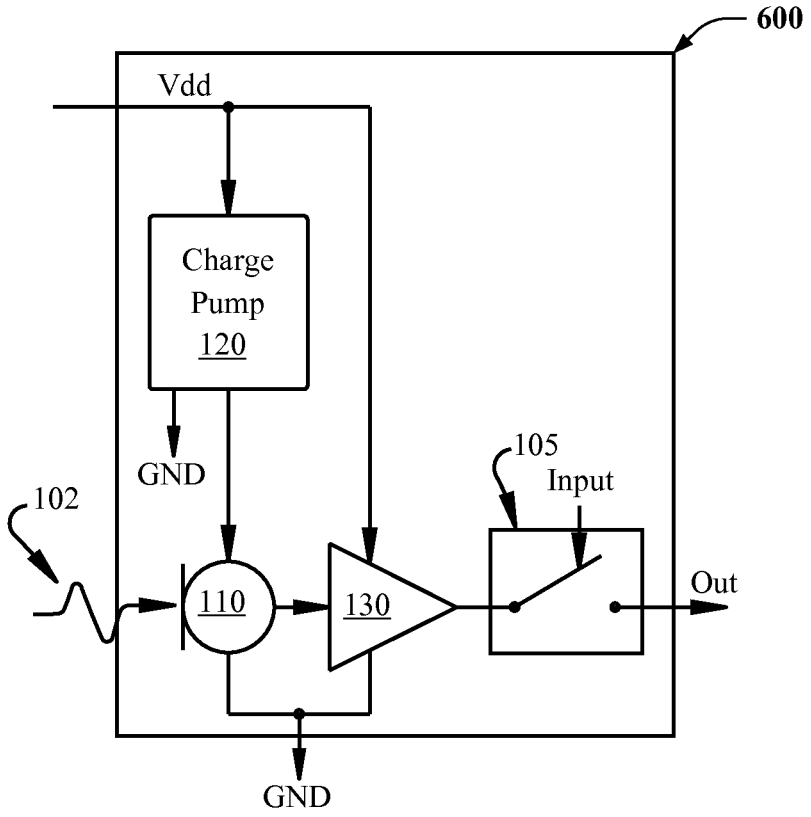
FIG. 6 illustrates a block diagram of a MEMS microphone with a switch for controlling propagation of an amplified signal between an electronic amplifier and an external device, in accordance with various embodiments.

Now referring to an embodiment illustrated by FIG. 6, MEMS microphone 600 includes switch 105, e.g., a mechanical switch, an electrical switch, e.g., a CMOS based switch, a sensor, a touch sensor, a capacitive sensor, a proximity sensor, a fingerprint sensor, etc. that can prevent, based on an input, e.g., "Input", received from a user of a device (not shown), e.g., a portable wireless device, a cellular phone, etc. including MEMS microphone 600, propagation of the amplified signal to an external device, e.g., for processing of the amplified signal.

It should be appreciated by a person of ordinary skill in the art of acoustic device technologies having the benefit of the instant disclosure that although switch 105 has been illustrated as opening a connection between the DC voltage source and various components, e.g., charge pump 120, electronic amplifier 130, etc. and/or opening a connection between such components, e.g., between charge pump 120 and acoustic membrane 110, between acoustic membrane 110 and electronic amplifier 130, between electronic amplifier 130 and an external device, etc., switch 105 can be configured to divert such connection(s) and/or other connections (see e.g. below with respect to embodiments illustrated by FIGS. 8-11) to other components (not shown), e.g., a pull-up resistor, a pull-down resistor, etc., e.g., so as to maintain input(s) to and/or output(s) from such components to a know state, e.g., logic "0", logic "1", etc.

Further, it should be appreciated by a person of ordinary skill in the art of acoustic device technologies having the benefit of the instant disclosure that although FIGS. 2-6 illustrate a single switch 105 being included in respective MEMS microphones (e.g., 200, 300, 400, 500, 600), such MEMS microphones, and/or other MEMS microphones described herein, in various embodiments, can include various combinations of switch 105 between the DC voltage source and various components of such MEMS microphones, and/or between, among, etc. such components, e.g., between the DC voltage source and charge pump 120, between the DC voltage source and electronic amplifier 130, between charge pump 120 and acoustic membrane 110, between acoustic membrane 110 and electronic amplifier 130, and/or between electronic amplifier 130 and an external device.

Figure 7:
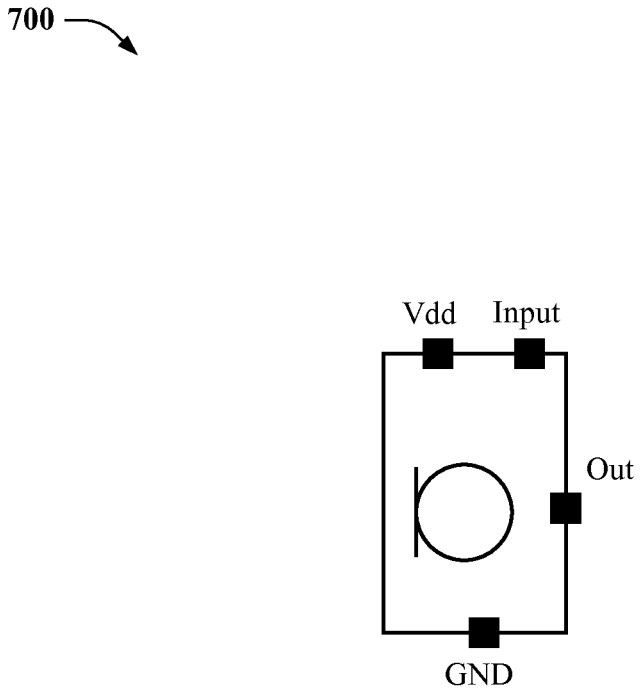
FIG. 7 illustrates a block diagram of a MEMS microphone chip including pins, in accordance with various embodiments.

Now referring to FIG. 7, and with respect to FIGS. 2-6, MEMS microphone chip 700 is illustrated, in accordance with various embodiments. MEMS microphone chip 700 can include a MEMS microphone (e.g., 200, 300, 400, 500, 600) that is electrically coupled to a source power pin, e.g., "Vdd", a ground power pin, e.g., "GND", an output pin, e.g., "Out", and an enable pin, e.g., "Input". In this regard, the source power pin electrically couples the DC voltage source to the MEMS microphone, the ground power pin electrically couples the DC voltage source to the MEMS microphone, the output pin electrically couples an amplified signal generated by electronic amplifier 130 to an external device (not shown), and an enable pin electrically couples an input signal to switch(es) 105. In this regard, switch(es) 105 can prevent, based on the input signal, the propagation of the DC voltage source to the charge pump, the propagation of the DC voltage source to the electronic amplifier, the propagation of the bias voltage to the acoustic membrane, the propagation of the electrical signal to the electronic amplifier, and/or the propagation of the amplified signal to the external device.

Figure 8:
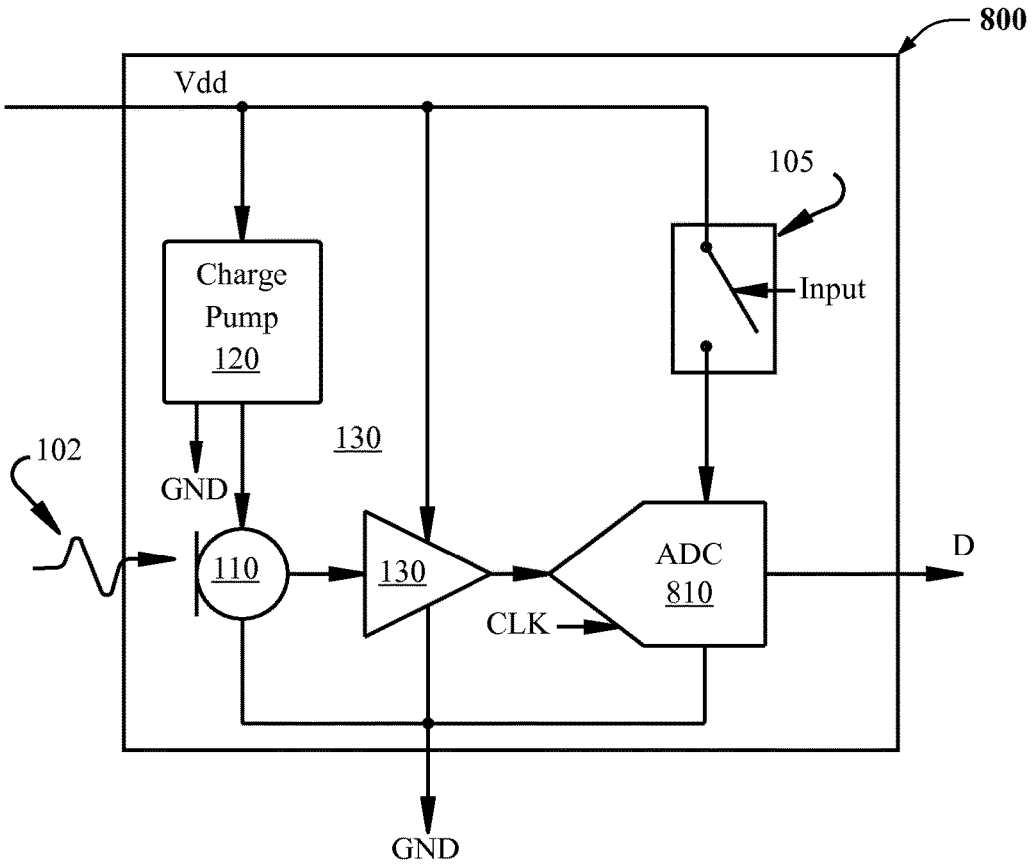
FIG. 8 illustrates a block diagram of a MEMS microphone with a switch for controlling propagation of a DC voltage source to an analog-to-digital converter (ADC), in accordance with various embodiments.

FIG. 8 illustrates a MEMS microphone (800) including switch 105 for controlling propagation of a DC voltage source to ADC 810, in accordance with various embodiments. In this regard, ADC 810, e.g., a direct-conversion ADC or flash ADC that utilizes a bank of comparators to generate a digital value, a successive-approximation ADC that utilizes a comparator to successively narrow a range that contains the input voltage, a delta-sigma or sigma-delta ADC that utilizes digital signal processing for encoding the input voltage into a digital value, etc. can receive an amplified electrical signal from electronic amplifier 130, and convert, based on a clock input, e.g., "CLK", the amplified electrical signal into a digital value, representation, etc. of the amplified electrical signal, e.g., into a binary value. In one embodiment, ADC 810 can output the digital value, e.g., "D", serially, e.g., via a serial peripheral interface (SPI), an inter-integrated circuit ($I^2C$) interface, etc.

In this regard, switch 105, e.g., a mechanical switch, an electrical switch, e.g., a CMOS based switch, a sensor, a touch sensor, a capacitive sensor, a proximity sensor, a fingerprint sensor, etc. can prevent, based on an input, e.g., "Input", received from a user of a device (not shown), e.g., a portable wireless device, a cellular phone, etc. including MEMS microphone 800, propagation of the DC voltage to ADC 810, e.g., disabling ADC 810 to prevent generation of a digital value corresponding to audio data received from acoustic membrane 110.

Figure 9:
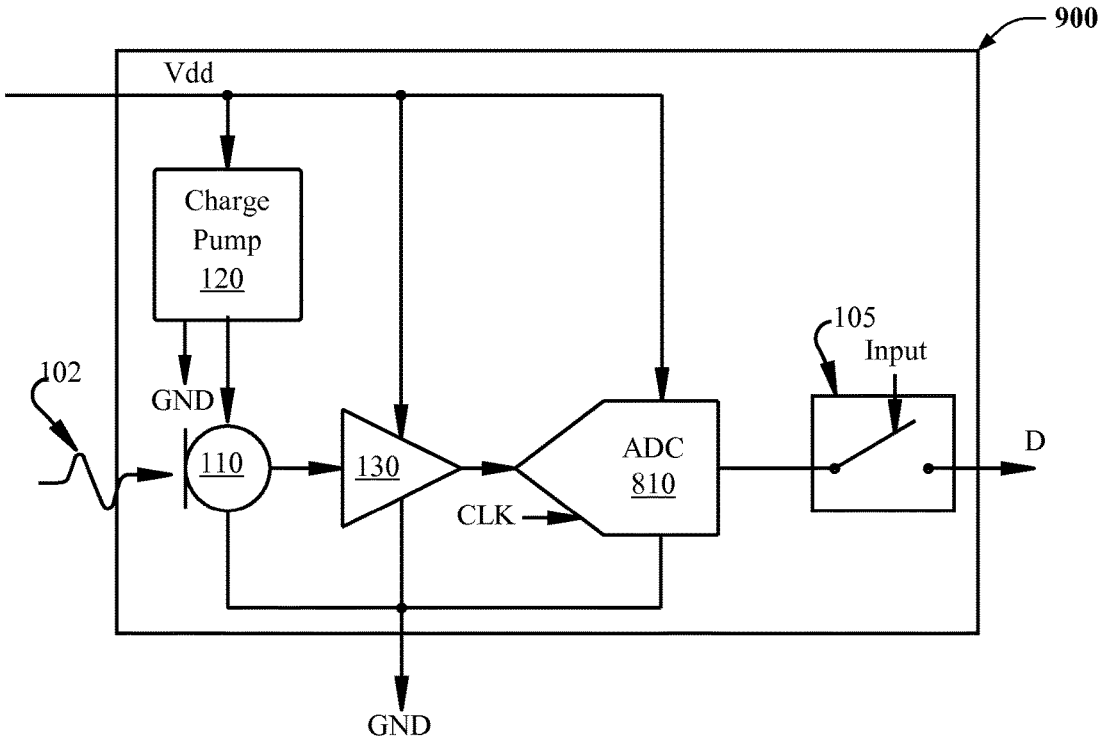
FIG. 9 illustrates a block diagram of a MEMS microphone with a switch for controlling propagation of a digital representation of an amplified signal between an ADC and an external device, in accordance with various embodiments.

FIG. 9 illustrates a MEMS microphone (900) including switch 105 for controlling propagation of a digital representation of an amplified signal between ADC 810 and an external device (not shown), in accordance with various embodiments. In this regard, ADC 810, e.g., a flash ADC, a successive-approximation ADC, a sigma-delta ADC, etc. can receive an amplified electrical signal from electronic amplifier 130, and convert, based on a clock input, e.g., "CLK", the amplified electrical signal into a digital value, representation, etc. of the amplified electrical signal, e.g., "D". Switch 105, e.g., a mechanical switch, an electrical switch, e.g., a CMOS based switch, a sensor, a touch sensor, a capacitive sensor, a proximity sensor, a fingerprint sensor, etc. can prevent, based on an input, e.g., "Input", received from a user of a device (not shown), e.g., a portable wireless device, a cellular phone, etc. including MEMS microphone 900, propagation of the digital representation, e.g., "D", of the amplified signal from ADC 810 to the external device (not shown).

Figure 10:
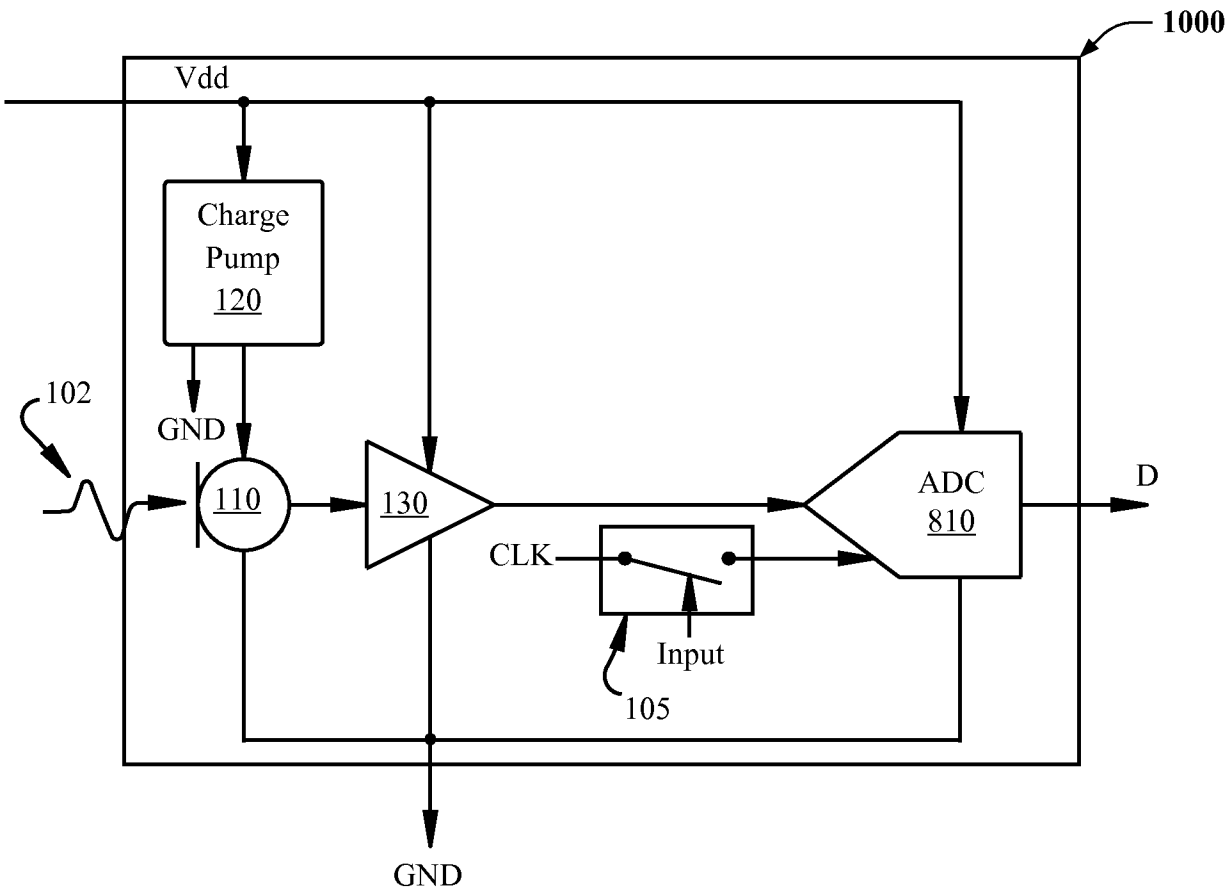
FIG. 10 illustrates a block diagram of a MEMS microphone with a switch for controlling propagation of a clock input to an ADC, in accordance with various embodiments.

Referring now to FIG. 10, a MEMS microphone (1000) including switch 105 for controlling propagation of a clock input, e.g., "CLK", to ADC 810 is illustrated, in accordance with various embodiments. In this regard, switch 105, e.g., a mechanical switch, an electrical switch, e.g., a CMOS based switch, a sensor, a touch sensor, a capacitive sensor, a proximity sensor, a fingerprint sensor, etc. can prevent, based on an input, e.g., "Input", received from a user of a device (not shown), e.g., a portable wireless device, a cellular phone, etc. including MEMS microphone 1000, propagation of the clock input to ADC 810, e.g., disabling conversion, by ADC 810, of an amplified electrical signal from electronic amplifier 130.

Figure 11:
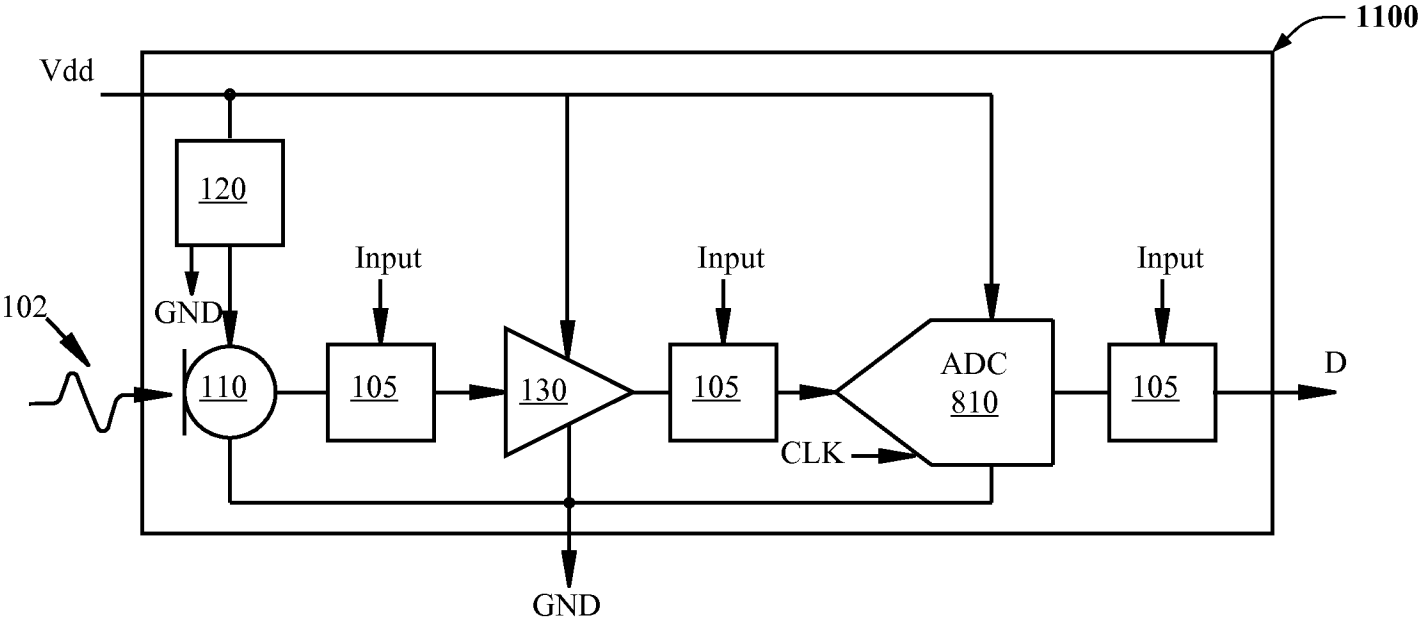
FIG. 11 illustrates a block diagram of a MEMS microphone with switches for controlling propagation of signals between components of the MEMS microphone, in accordance with various embodiments.

FIG. 11 illustrates a MEMS microphone (1100) with switches (105) for controlling propagation of signals between components of MEMS microphone 1100, in accordance with various embodiments. In this regard, MEMS microphone 1100 can include switch 105 between acoustic membrane 110 and electronic amplifier 130, switch 105 between electronic amplifier 130 and ADC 810, and switch 105 between ADC 810 and an external device (not shown) to prevent propagation of electrical signals, e.g., the electrical signal, the amplified signal, the digital value, etc. It should be appreciated by a person of ordinary skill in the art of acoustic device technologies having the benefit of the instant disclosure that in other embodiments not illustrated, various combinations of switch 105 can be included in MEMS microphone 1100, e.g., between the DC voltage source and charge pump 120, between the DC voltage source and electronic amplifier 130, and/or between the DC voltage source and ADC 810.

Figure 12:
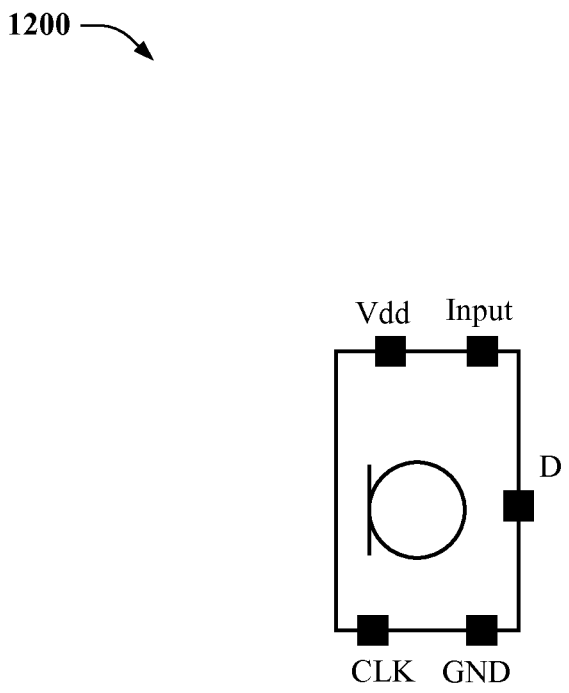
FIG. 12 illustrates a block diagram of another MEMS microphone chip including pins, in accordance with various embodiments.

Now referring to FIG. 12, and with respect to FIGS. 8-11, MEMS microphone chip 1200 is illustrated, in accordance with various embodiments. MEMS microphone chip 1200 can include a MEMS microphone (e.g., 800, 900, 1000, 1100) that is electrically coupled to a source power pin, e.g., "Vdd", a ground power pin, e.g., "GND", a clock input pin, e.g., "CLK", a digital output pin, e.g., "D", and an enable pin, e.g., "Input". In this regard, the source power pin electrically couples the DC voltage source to the MEMS microphone, the ground power pin electrically couples the DC voltage source to the MEMS microphone, the clock input pin electrically couples a clock input to ADC 810, the digital output pin electrically couples the digital value generated by ADC 810 to an external device (not shown), and the enable pin electrically couples an input signal to switch(es) 105. In this regard, switch(es) 105 can prevent, based on the input signal, propagation of the DC voltage source to various components of the MEMS microphone, and/or propagation of electrical signals between various components of the MEMS microphone.

Figure 13:
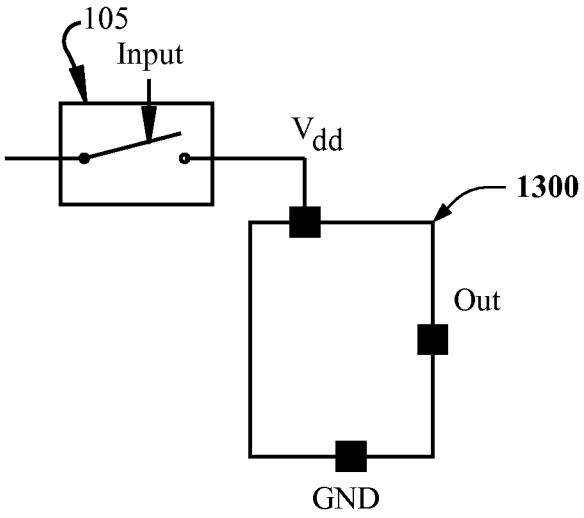
FIG. 13 illustrates a block diagram of a MEMS microphone chip with a pin coupled to a switch for controlling propagation of a DC voltage source to the MEMS microphone chip, in accordance with various embodiments.

FIG. 13 illustrates a MEMS microphone chip (1300) including MEMS microphone 100, in accordance with various embodiments. MEMS microphone 100 is electrically coupled to a source power pin, e.g., "Vdd", a ground power pin, e.g., "GND", and an output pin, e.g., "Out". In this regard, the source power pin electrically couples the DC voltage source to MEMS microphone 100, the ground power pin electrically couples the DC voltage source to MEMS microphone 100, and the output pin electrically couples an amplified signal generated by electronic amplifier 130 to an external device (not shown). Switch 105 is electrically coupled to the source power pin, and can prevent, based on an input, e.g., "Input", received from a user of a device (not shown), e.g., a portable wireless device, a cellular phone, etc. that includes MEMS microphone chip 1300, propagation of a DC voltage source to MEMS microphone chip 1300.

Figure 14:
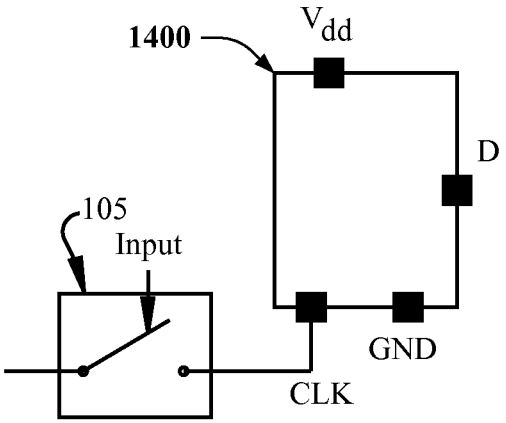
FIG. 14 illustrates a block diagram of a MEMS microphone chip with a pin coupled to a switch for controlling propagation of a clock input to an ADC of the MEMS microphone chip, in accordance with various embodiments.

FIG. 14 illustrates a MEMS microphone chip (1400) including components of MEMS microphone 100 and an ADC, e.g., ADC 810, in accordance with various embodiments. In this regard, such components can be electrically coupled to a DC voltage source via a source power pin, e.g., "Vdd", and a ground power pin, e.g., "GND". Further, the ADC, e.g., ADC 810, can be electrically coupled to an output of electronic amplifier 130, a clock input pin, e.g., "CLK", and a digital output pin, e.g., "D". Switch 105 is electrically coupled to the clock input pin, and can prevent, based on an input, e.g., "Input", received from a user of a device (not shown), e.g., a portable wireless device, a cellular phone, etc. that includes MEMS microphone chip 1400, propagation of a clock input to MEMS microphone chip 1400, e.g., to the ADC.

Figure 15:
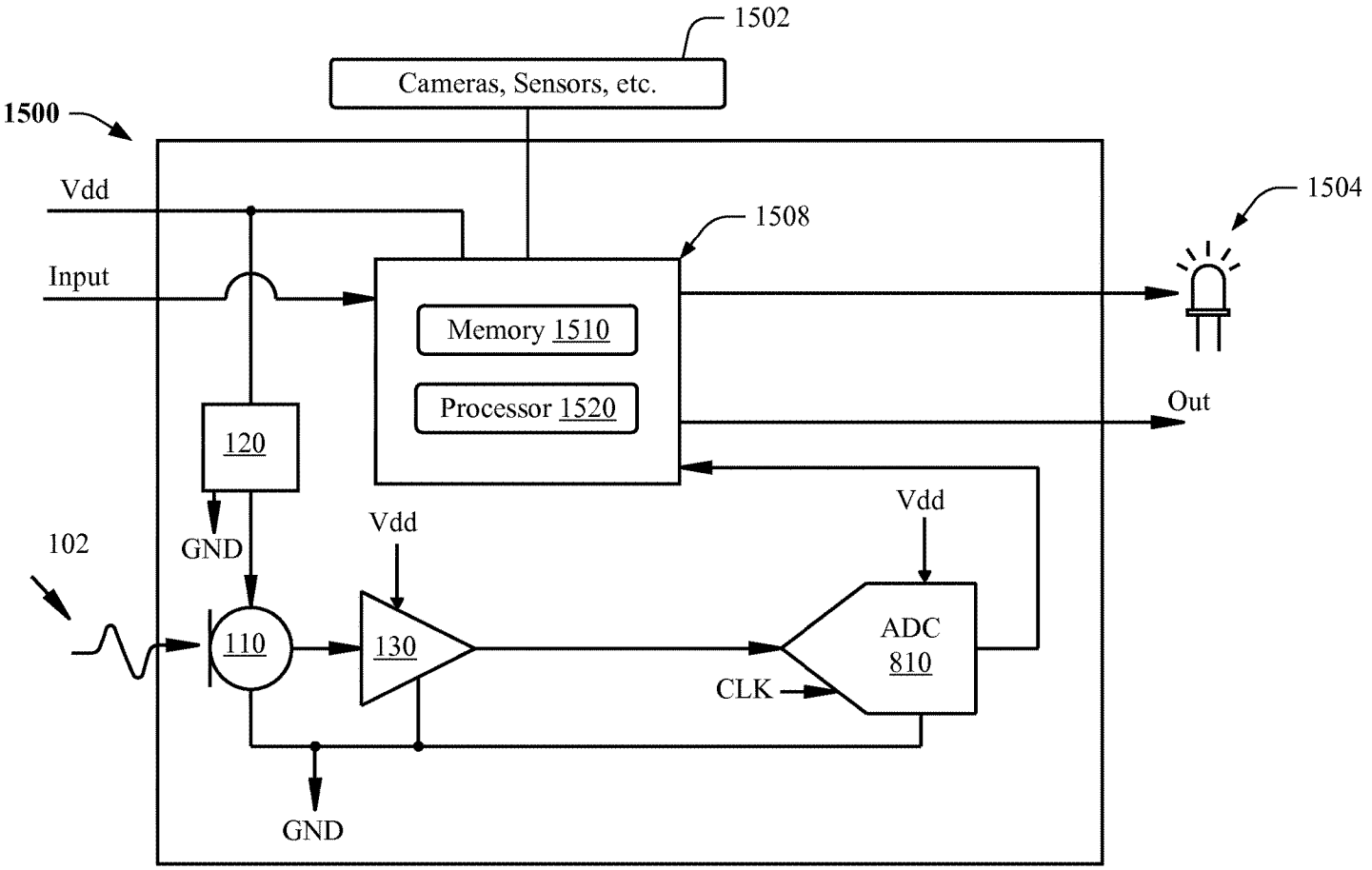
FIG. 15 illustrates a block diagram of a MEMS microphone including a processor, in accordance with various embodiments.

Now referring to FIG. 15, a MEMS microphone (1500) including a processor is illustrated, in accordance with various embodiments. MEMS microphone 1500 can include acoustic membrane 110 that converts, based on a bias voltage generated by charge pump 120, acoustic signal 102, e.g., a sound, an acoustic wave, an acoustic-based vibration, etc. into an electrical signal—charge pump 120 applying the bias voltage to acoustic membrane 110 as a function of a DC voltage source supplying power to charge pump 120. Further MEMS microphone 1500 can include electronic amplifier 130 that increases an amplitude of the electrical signal to generate an amplified electrical signal, acoustic-based electrical signal, etc.

ADC 810, e.g., a flash ADC, a successive-approximation ADC, a sigma-delta ADC, etc. can convert, based on a clock input, e.g., "CLK", the amplified electrical signal into a digital value, representation, etc. of the amplified electrical signal. Processing component 1508, e.g., a digital signal processor (DSP), including memory 1510 and processor 1520, can receive the digital value. In this regard, processing component 1508 can encrypt the digital value as encrypted data, and send the encrypted data directed to an external device (not shown).

In one embodiment, processing component 1508 can compress the digital value as compressed data, and encrypt the compressed data as the encrypted data. In another embodiment, processing component 1508 can receive an input, e.g., "Input", from a user of a device (not shown), e.g., a portable wireless device, a cellular phone, etc. and encrypt, based on the input, the digital value as the encrypted data. In this regard, in an embodiment, in response to the digital value not being encrypted according to the input, processing component 1508 can send the digital value directed to an external device (not shown).

In yet another embodiment, processing component 1508 can receive, via acoustic membrane 110, voice data representing a voice of the user of MEMS microphone 1500, and store the voice data in memory 1510. In an embodiment, processing component 1508 can store a voice recognition algorithm in memory 1510, and receive the voice data using the voice recognition algorithm. In one embodiment, processing component 1508 can verify that the voice data corresponds to the user of MEMS microphone 1500 utilizing speaker authentication or verification. Further, processing component 1510 can encrypt the digital value as the encrypted data in response to verification of the voice data using the speaker authentication. In another embodiment, processing component 1510 can receive, via acoustic membrane 110, an ultrasonic signal. In this regard, processing component 1510 can encrypt, based on the ultrasonic signal, the digital value as the encrypted data.

In an embodiment, processing component 1508 can send the encrypted data, e.g., to an external device (not shown), using an SPI and/or $I^2C$ based interface, e.g., via an output pin, e.g., "Out". In another embodiment, processing component 1508 can send output signal(s) directed to external device(s) 1502, e.g., including a camera, a sensor, etc., including light emitting diode (LED) 1504, etc.—the output signal(s) representing whether the microphone is in a secure mode, e.g., processing component 1510 has encrypted data, voice data, etc. In another embodiment, processing component 1508 can send the digital value, e.g., to an external device (not shown), using the SPI and/or $I^2C$ based interface, e.g., via the output pin, e.g., "Out".

Figure 16:
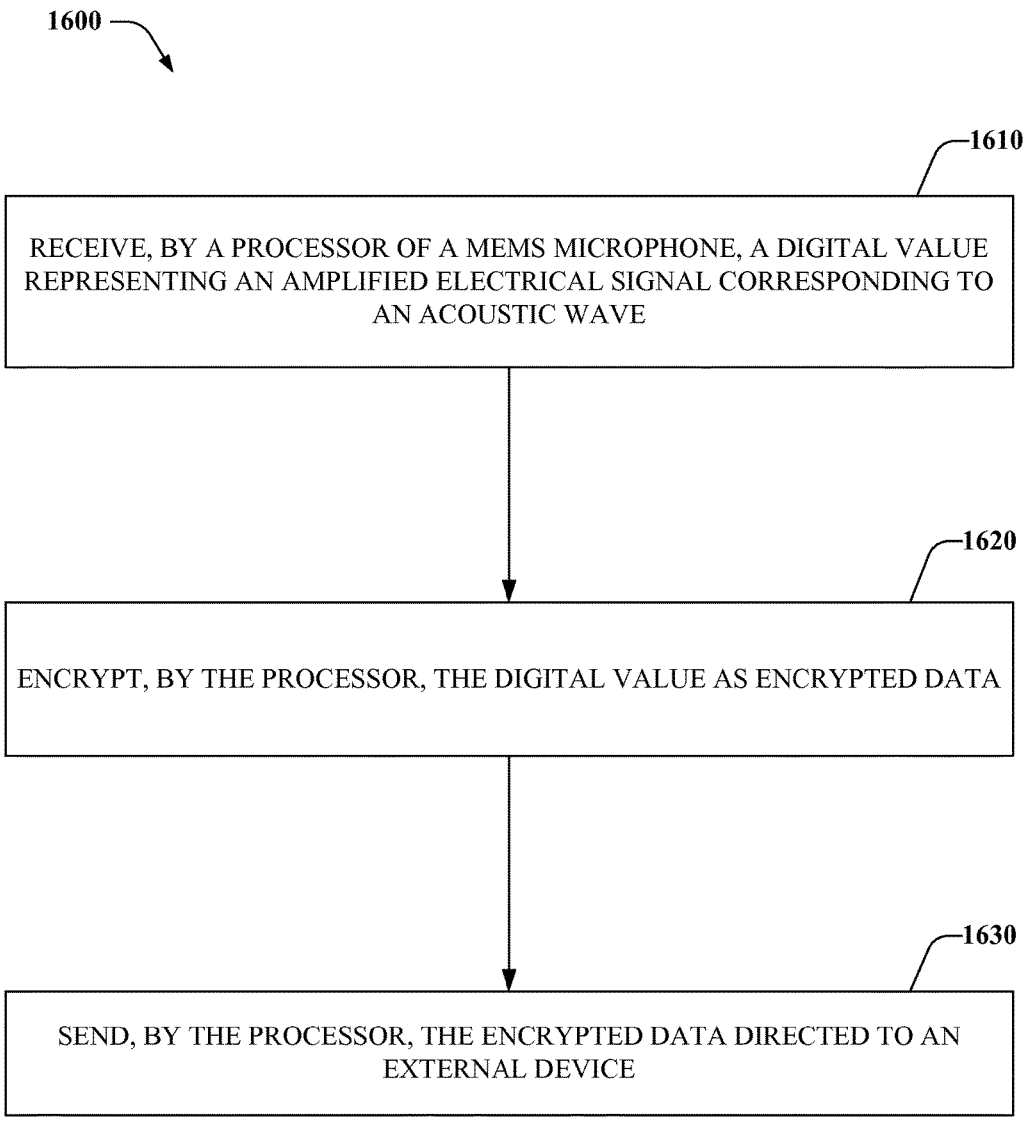
FIGS. 16-17 illustrate flowcharts of methods associated with a MEMS microphone including a processor, in accordance with various embodiments.
Figure 17:
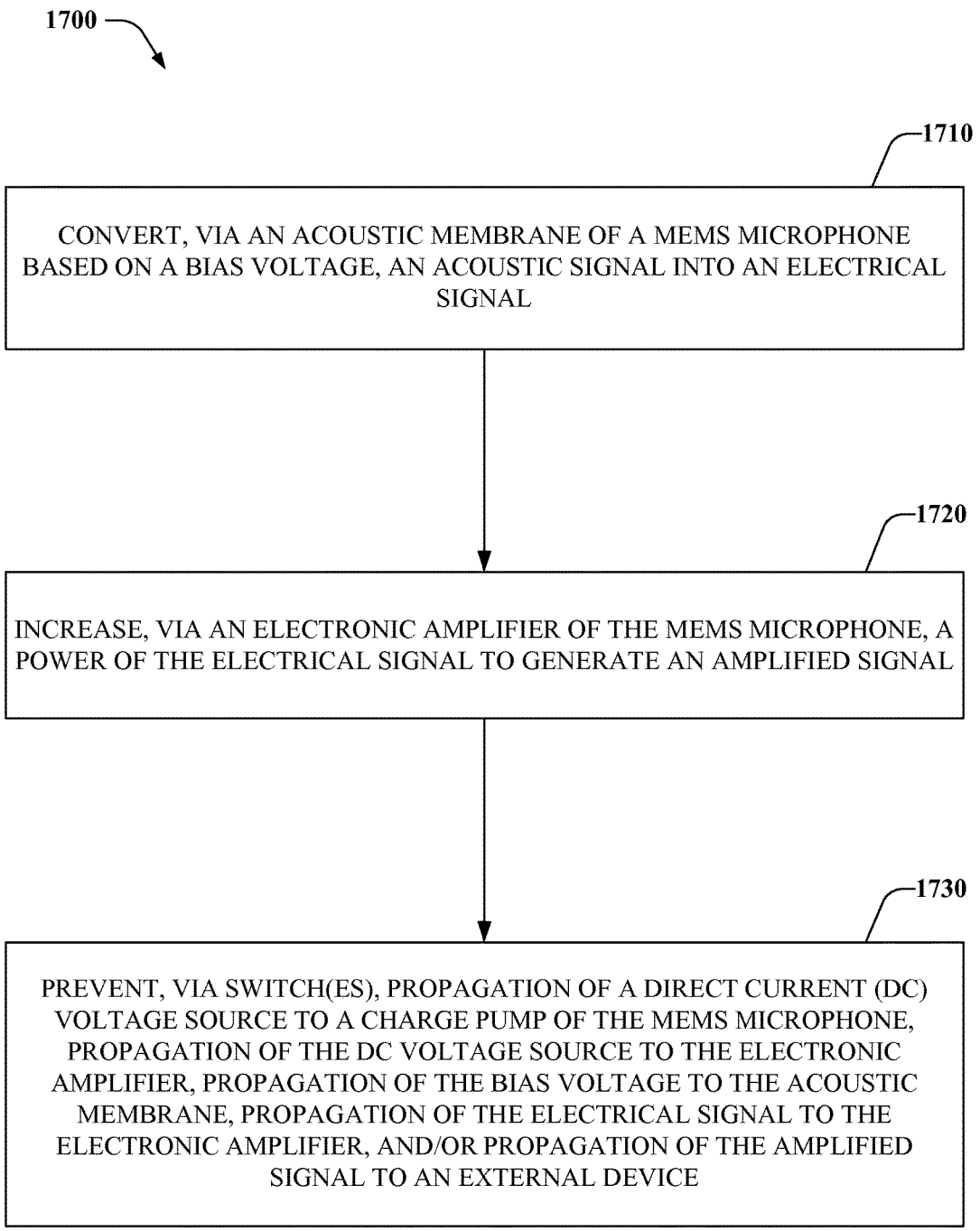

FIGS. 16-17 illustrate methodologies in accordance with the disclosed subject matter. For simplicity of explanation, the methodologies are depicted and described as a series of acts. It is to be understood and appreciated that various embodiments disclosed herein are not limited by the acts illustrated and/or by the order of acts. For example, acts can occur in various orders and/or concurrently, and with other acts not presented or described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be further appreciated that methodologies disclosed hereinafter and throughout this specification are capable of being stored on an article of manufacture to facilitate transporting and transferring such methodologies to computers, processors, processing components, etc. The term article of manufacture, as used herein, is intended to encompass a computer program accessible from any computer-readable device, carrier, or media.

Referring now to FIG. 16, process 1600 performed by a MEMS microphone, e.g., 1500, is illustrated, in accordance with various embodiments. At 1610, a digital value representing an amplified electrical signal corresponding to an acoustic wave that has been detected by MEMS microphone 1500 can be received by a processing component, e.g., 1508, of MEMS microphone 1500. At 1620, the digital value can be encrypted, by the processing component, as encrypted data. At 1630, the encrypted data can be sent, by the processing component, directed to an external device.

FIG. 17 illustrates another process (1700) performed by a MEMS microphone, e.g., 1500, in accordance with various embodiments. At 1710, an acoustic signal can be converted into an electrical signal, e.g., using a bias voltage, via an acoustic membrane of MEMS microphone 1500. At 1720, a power of the electrical signal can be increased, via an electronic amplifier of MEMS microphone 1500, to generate an amplified signal. At 1730, propagation of a DC voltage source to a charge pump of MEMS microphone 1500, propagation of the DC voltage source to the electronic amplifier, propagation of the bias voltage to the acoustic membrane, propagation of the electrical signal to the electronic amplifier, and/or propagation of the amplified signal to an external device can be prevented via switch(es).

As it employed in the subject specification, the terms "processor", "processing component", etc. can refer to substantially any computing processing unit or device, e.g., processor 1520, comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions and/or processes described herein. Further, a processor can exploit nano-scale architectures such as, but not limited to, molecular and quantum-dot based transistors, switches and gates, e.g., in order to optimize space usage or enhance performance of mobile devices. A processor can also be implemented as a combination of computing processing units, devices, etc.

In the subject specification, terms such as "memory" and substantially any other information storage component relevant to operation and functionality of MEMS microphones and/or devices disclosed herein, e.g., memory 1510, refer to "memory components," or entities embodied in a "memory," or components comprising the memory. It will be appreciated that the memory can include volatile memory and/or nonvolatile memory. By way of illustration, and not limitation, volatile memory, can include random access memory (RAM), which can act as external cache memory. By way of illustration and not limitation, RAM can include synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), Rambus direct RAM (RDRAM), direct Rambus dynamic RAM (DRDRAM), and/or Rambus dynamic RAM (RDRAM). In other embodiment(s) nonvolatile memory can include read only memory (ROM), programmable ROM (PROM), electrically programmable ROM (EPROM), electrically erasable ROM (EEPROM), or flash memory. Additionally, the MEMS microphones and/or devices disclosed herein can comprise, without being limited to comprising, these and any other suitable types of memory.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A micro-electro-mechanical system (MEMS) microphone, comprising:

an acoustic membrane that converts an acoustic signal into an electrical signal based on a bias voltage that has been applied, using a charge pump, to the acoustic membrane using a charge pump;

an electronic amplifier that comprises an amplifier power input, an amplifier signal input, and an amplifier signal output, and that receives, at the amplifier signal input, the electrical signal from the acoustic membrane, increases, based on the amplifier power input, an amplitude of the electrical signal, and generates, at the amplifier signal output, an amplified signal representing the electrical signal; and a switch that is configured to prevent propagation of a direct current (DC1 voltage source from a source power pin of the MEMS microphone to the amplifier power input to disable generation of the amplified signal representing the electrical signal that is output from the acoustic membrane to facilitate security of audio data of the MEMS microphone.

2. The MEMS microphone of claim 1, where in the MEMS microphone is a piezoelectric device or a piezoresistive device.

3. The MEMS microphone of claim 1, wherein the switch is a first switch, and further comprising:

at least one of:

a second switch that is configured to prevent propagation of the DC voltage source from the source power pin to the charge pump; or a third switch that is configured to prevent propagation of the bias voltage from the charge pump to the acoustic membrane.

4. The MEMS microphone of claim 1, wherein the switch comprises a mechanical switch or an electrical switch.

5. The MEMS microphone of claim 1, wherein the switch comprises a sensor, a touch sensor, a proximity sensor, or a fingerprint sensor.

6. The MEMS microphone of claim 1, wherein the switch is a first switch, wherein the propagation is a first propagation, and further comprising:

a ground power pin that electrically couples the DC voltage source to the MEMS microphone;

an output pin that electrically couples the amplified signal to an external device; and an enable pin that electrically couples an input signal to the first switch, wherein the first switch prevents, based on the input signal, the first propagation of the DC voltage source from the source power pin to the amplifier power input; and a second switch that prevents, based on the input signal, a second propagation of the amplified signal from the amplifier signal output to the output pin.

7. The MEMS microphone of claim 1, further comprising an analog-to-digital converter (ADC) that converts the amplified signal into a digital representation of the amplified signal.

8. The MEMS microphone of claim 7, wherein the switch is a first switch, and further comprising:

a second switch that is configured to prevent propagation of the DC voltage source from the source power pin to the ADC.

9. The MEMS microphone of claim 7, wherein the switch is a first switch, and further comprising:

a second switch that is configured to prevent propagation of the digital representation of the amplified signal to an external device.

10. The MEMS microphone of claim 7, wherein the switch is a first switch, and further comprising:

a second switch that is configured to prevent propagation of a clock input to the ADC.

11. The MEMS microphone of claim 1, wherein the switch is a first switch, and further comprising:

a second switch electrically that is coupled to the source power pin of the MEMS microphone and configured to prevent propagation of the DC voltage source to the source power pin to facilitate the security of the audio data of the MEMS microphone, wherein the source power pin supplies the DC voltage source to the charge pump.

12. A micro-electro-mechanical system (MEMS) microphone, comprising:

an acoustic membrane that converts, based on a bias voltage that has been applied to the acoustic membrane using a charge pump, an acoustic vibration into an electrical signal;

an electronic amplifier that increases, according to an amplifier power input of the electronic amplifier, an amplitude of the electrical signal to generate an amplified electrical signal representing the acoustic vibration, wherein a power pin of the MEMS microphone supplies a direct current (DC) voltage source to the charge pump and the amplifier power input; and a switch that is configured to prevent propagation of the DC voltage source from the power pin of the MEMS microphone to the amplifier power input of the electronic amplifier to disable generation of the amplified electrical signal representing the acoustic vibration to facilitate security of audio data corresponding to the acoustic vibration.

13. The MEMS microphone of claim 12, wherein the switch comprises a mechanical switch or an electrical switch.

14. The MEMS microphone of claim 12, wherein the switch comprises a sensor, a touch sensor, a proximity sensor, or a fingerprint sensor.

15. The MEMS microphone of claim 12, further comprising:

an analog-to-digital converter (ADC) that converts the amplified electrical signal into a digital value.

16. The MEMS microphone of claim 15, wherein the switch is a first switch, and further comprising:

a second switch configured to prevent propagation of the amplified electrical signal to the ADC.

17. The MEMS microphone of claim 15, wherein the switch is a first switch, and further comprising:

a second switch configured to prevent propagation of the digital value to an external device.

18. The MEMS microphone of claim 12, wherein the switch is a first switch, and further comprising:

a ground power pin that electrically couples the DC voltage source to the electronic amplifier;

an output pin that electrically couples the amplified electrical signal to an external device; and an enable pin that electrically couples an input signal to a second switch that prevents, based on the input signal, propagation of the amplified electrical signal to the external device.

19. The MEMS microphone of claim 12, wherein the switch is a first switch, and further comprising:

a second switch that is configures to prevent propagation of the DC voltage source to the power pin of the MEMS microphone to facilitate the security of the audio data corresponding to the acoustic vibration.

* * * * *